US007036475B2

(12) United States Patent
Yasuda et al.

(10) Patent No.: US 7,036,475 B2
(45) Date of Patent: May 2, 2006

(54) LASH ADJUSTER FOR VALVE GEAR

(75) Inventors: Yoshiteru Yasuda, Kanagawa (JP); Kenshi Ushijima, Kanagawa (JP); Eiji Maeno, Shizuoka (JP); Ken Yamamoto, Shizuoka (JP)

(73) Assignees: Nissan Motor Co., Ltd., Kanagawa (JP); NTN Corporation, Osaka (JP)

( * ) Notice: Subject to any disclaimer, the term of this patent is extended or adjusted under 35 U.S.C. 154(b) by 0 days.

(21) Appl. No.: 10/773,278

(22) Filed: Feb. 9, 2004

(65) Prior Publication Data

US 2004/0154572 A1 Aug. 12, 2004

(30) Foreign Application Priority Data

Feb. 10, 2003 (JP) ..... 2003-032726

(51) Int. Cl.
*F01L 1/14* (2006.01)

(52) U.S. Cl. ..... 123/90.52; 123/90.45; 123/90.48

(58) Field of Classification Search ..... 123/90.33, 123/90.35, 90.45, 90.48, 90.52, 90.54
See application file for complete search history.

(56) References Cited

U.S. PATENT DOCUMENTS 2,320,385 A 6/1943 Rockstroh
3,936,577 A * 2/1976 Christini et al. ..... 428/614
4,548,168 A 10/1985 Gill
4,706,620 A 11/1987 Gill
5,204,890 A * 4/1993 Anno et al. ..... 378/133
5,389,452 A * 2/1995 Nakajima et al. ..... 428/624
6,032,630 A * 3/2000 Yamamoto et al. ..... 123/90.54
6,109,228 A * 8/2000 Yamamoto et al. ..... 123/90.54
6,592,356 B1 * 7/2003 Lust et al. ..... 425/192 R
6,729,288 B1 * 5/2004 Yamamoto et al. ..... 123/90.54

FOREIGN PATENT DOCUMENTS

JP 08129938 A * 5/1996
JP 11-324617 11/1999
JP 11-324618 11/1999
WO 01/57367 8/2001

* cited by examiner

*Primary Examiner*—Thomas Denion
*Assistant Examiner*—Ching Chang
(74) *Attorney, Agent, or Firm*—Wenderoth, Lind & Ponack, L.L.P.

(57) ABSTRACT

In a lash adjuster of a valve gear which employs a serration-shaped thread mechanism, the formation of a tribochemical reactive film is suppressed by using as the materials for its adjuster screw and nut member (or the materials for their thread surfaces) materials that, even if FM oil is used, the friction coefficient will not extremely decrease. The nut member is provided on the underside of an end plate of a lifter body. The adjuster screw is threadedly engaged in a threaded hole of the nut member. The adjuster screw is biased by a return spring. The female threads of the threaded hole and the male threads of the adjuster screw are serration shaped. One or both of the nut member and the adjuster screw, or the pressured thread surfaces of one or both of them, are formed of a material that will not react with oil additives of FM oil to suppress the formation of tribochemical reactive film, thereby stabilizing the operation of the lash adjuster.

9 Claims, 7 Drawing Sheets

LASH ADJUSTER FOR VALVE GEAR

BACKGROUND OF THE INVENTION

This invention relates to a lash adjuster for automatically adjusting the valve clearance of a valve gear in an internal combustion engine.

In a line for feeding fuel to an internal combustion engine or a line for discharging exhaust gas, a valve gear is provided to open and close an intake valve or exhaust valve (hereinafter called simply valve) by the rotation of a cam. This valve gear includes a lash adjuster for automatically adjusting the valve clearance.

Such a valve gear includes a cam, a valve and a valve stem provided on the valve. When the end face of the valve stem is pressed against the end face of an adjuster screw by the force of a valve spring which presses the valve stem toward the cam, this force is transmitted to the cam through a lifter body to open and close the valve as the cam rotates. Generally, the lash adjuster is mounted between the cam and the valve stem provided on the valve.

Such lash adjusters are known in which a threaded hole having a closed end is formed in the lifter body, the adjuster screw in threaded engagement with the threaded hole is axially biased by an elastic member mounted in the threaded hole at its closed end, and the female threads of the threaded hole and the male threads of the adjuster screw are serration-shaped such that the flank angle of the pressure flanks, which receive the push-in load applied to the adjuster screw, is greater than the flank angle of the clearance flanks to adjust any valve clearance. Such adjusters are disclosed in U.S. Pat. No. 4,548,168, and JP patent publications 11-324617 and 11-324618.

In such a lash adjuster, when a valve clearance tends to develop between the valve stem and the adjuster screw due, for example, to thermal expansion of the cylinder head, the adjuster screw moves axially while rotating along the clearance flanks under the push-in force of the elastic member, thereby absorbing the valve clearance. Conversely, when the adjuster screw is acted upon by a push-in force from the valve stem, it retracts until an axial gap formed at the thread engagement portions between the male and female threads disappears. When further push-in force is applied, it is borne by the pressure flanks, which are pressed against each other, thereby preventing the adjuster screw from retracting while rotating.

If the distance between the valve stem end and the camshaft shortens due, for example, to wear of the valve seat, the adjuster screw prevents the valve from being gradually pushed in due to axial variable loads applied from the camshaft, so that a pressure leak occurs because the valve is not completely shut even when the base circle of the cam abuts the cylinder head. At this time, the adjuster screw is further pushed in by an amount corresponding to the play of the threads from a position where the minimum value of the axial variable loads is zero, but never retracts any further.

Serration-shaped threads used for such a lash adjuster have two kinds of flanks, i.e. pressure flanks, which receive push-in loads applied to the adjuster screw, and clearance flanks, and have self-sustainable friction coefficients $\mu s$ determined univocally by the friction coefficients $\mu$ between the thread surfaces of the male threads and female threads on the respective flank surfaces, and thread specifications. Generally, the threads are designed such that the self-sustainable friction coefficient $\mu s$ of the pressure flanks is smaller than the friction coefficient $\mu$ between the thread surfaces, and that the self-sustainable friction coefficient $\mu s$ of the clearance flanks is greater than the friction coefficient $\mu$ between the thread surfaces.

Specifically, the friction coefficient $\mu$ between the thread surfaces in such a lash adjuster is experimentally known to be about 0.1–0.15. For example, in the embodiments of the inventions described in the above-mentioned three patent publications, by setting the lead angle $\alpha$=11.5°, pressure flank angle $\theta_1$=75°, clearance flank angle $\theta_2$=15°, the threads can be designed such that the self-sustainable friction coefficient $\mu s$ of the pressure flanks is smaller than the friction coefficient $\mu$ between the thread surfaces, and the self-sustainable friction coefficient $\mu s$ of the clearance flanks is greater than the friction coefficient $\mu$ between the thread surfaces (see FIG. 8).

On the other hand, in recent years, in automotive engines, for the purpose of reducing friction and direct contact of slide portions, motor oil containing organic molybdenum (friction modifier oil; hereinafter referred to as FM oil) is generally used. By using FM oil, a film that has an extremely low friction coefficient is formed on slide portions, so that slide resistance of various portions decreases. This helps to improve the fuel cost of automobiles. Typical organic molybdenums include molybdenum dialkyldithiocarbamate sulfide (alias molybdenum dithiocarbamate; MoDTC), and oxymolybdenum sulfide.dialkyldithiophosphate (alias molybdenum dithiophosphate; MoDTP). They have friction relaxing property, wear resistance, extreme pressure property, and oxidation resistance.

These effects are achieved in cooperation with ZnDTP (zinc dialkyldithiophosphate) which is an oil additive, and it is known that the friction coefficient can be reduced more markedly than if used alone. It is said that this is because ZnDTP forms iron phosphate on the substrate, and forms an $MoS_2$ film thereon. Also, ZnDTP is high in reactivity with iron, and it is reported that such a tribochemical reactive film is not formed on slide surfaces provided with, for example, DLC film due to its chemical stability (technical magazine "TRIBOLOGIST" Vol. 47/No. 11/2002/page 819).

But in an engine in which is mounted such a lash adjuster, if FM oil described above is used, the friction coefficient $\mu$ between the thread surfaces may drop extremely to about 0.04. If the friction coefficient $\mu$ falls below the self-sustainable friction coefficient $\mu s$ of the pressure flanks, slip may occur on the pressure flanks. If slip on the pressure flanks is excessive, when axial load is applied to the lash adjuster, the adjuster screw is pushed in, thus causing valve lift loss and causing the valve to get impulsively seated, thus producing abnormal sounds.

An object of this invention is to provide an improved lash adjuster for a valve gear employing a serration-shaped thread mechanism which suppresses the formation of tribochemical reactive film by using materials for the adjuster screw and the nut member, or for the thread surfaces thereof, with which the friction coefficient between the thread surfaces will not extremely decrease even under conditions in which FM oil is used for the engine.

SUMMARY OF THE INVENTION

According to this invention, there is provided a lash adjuster in a valve gear comprising a nut member provided on a lifter body axially slidably mounted in a transmission path for a valve opening/closing force transmitted from a cam to a valve through a valve stem, an adjuster screw moving axially by rotating in the nut member for automatically adjusting a valve clearance, and an elastic member for axially biasing the adjuster screw. Female threads of the nut member and male threads formed on the outer periphery of the adjuster screw are serration-shaped such that the flank angle of pressure flanks acted on by axial push-in force applied to the adjuster screw is greater than the flank angle of clearance flanks. One or both of the adjuster screw and the nut member, or pressure side thread surfaces of one or both of them, are formed of a material that will not react with oil additives of oil containing organic molybdenum.

With this lash adjuster, the formation of a tribochemical reactive film is suppressed under conditions in which FM oil is used. The prerequisite thereof is that the nut member and the adjuster screw used have serration-shaped threads.

Serration-shaped threads used for the lash adjuster will now be described. Generally, if axial compressive loads are applied to threads, irrespective of the magnitude of the axial loads, if the friction coefficient $\mu$ between the thread surfaces is greater than the self-sustainable friction coefficient $\mu s = \tan \alpha \cos \theta$ ($\alpha$: lead angle, $\theta$: flank angle), which is determined univocally by the specs of the threads, the threads will stand still without causing slip rotation. Conversely, if the friction coefficient $\mu$ between the thread surfaces is smaller than the self-sustainable friction coefficients $\mu s$, the threads will rotate while slipping and be pushed in.

With the serration-shaped threads used for the lash adjuster, the flank angle of the pressure flank, which receives the push-in load applied to the adjuster screw, is larger than the flank angle of the clearance flank. Their flank angles are designed such that the self-sustainable friction coefficient $\mu s$ of the pressure flank surfaces is smaller than the friction coefficient $\mu$ between the thread surfaces, and the self-sustainable friction coefficient $\mu s$ of the clearance flank surfaces is larger than the friction coefficient $\mu$ between the thread surfaces.

As a result, in mounting the lash adjuster in an internal combustion engine, if valve clearance tends to develop between the valve stem and the adjuster screw due, for example, to thermal expansion of the cylinder head, the adjuster screw will move axially while turning along the clearance flanks under the biasing force of the elastic member, thus absorbing the valve clearance.

When the adjuster screw is acted on by a push-in force from the valve stem, it will retract until the axial thread gap formed between the male and female threads disappears. When further push-in force acts, it is borne by the pressure flanks, which are pressed against each other, thereby preventing the adjuster screw from retracting while rotating.

With the lash adjuster using such serration-shaped threads, since a material that will not react with oil additives of FM oil is used for the materials of one or both of the nut member and the adjuster screw or the pressure side thread surfaces of one or both of them, the formation of a film such as $MoS_2$ film, which is a tribochemical reactive film, is suppressed. This prevents the friction coefficient $\mu$ between the thread surfaces from reducing extremely. Thus stable valve action is assured.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
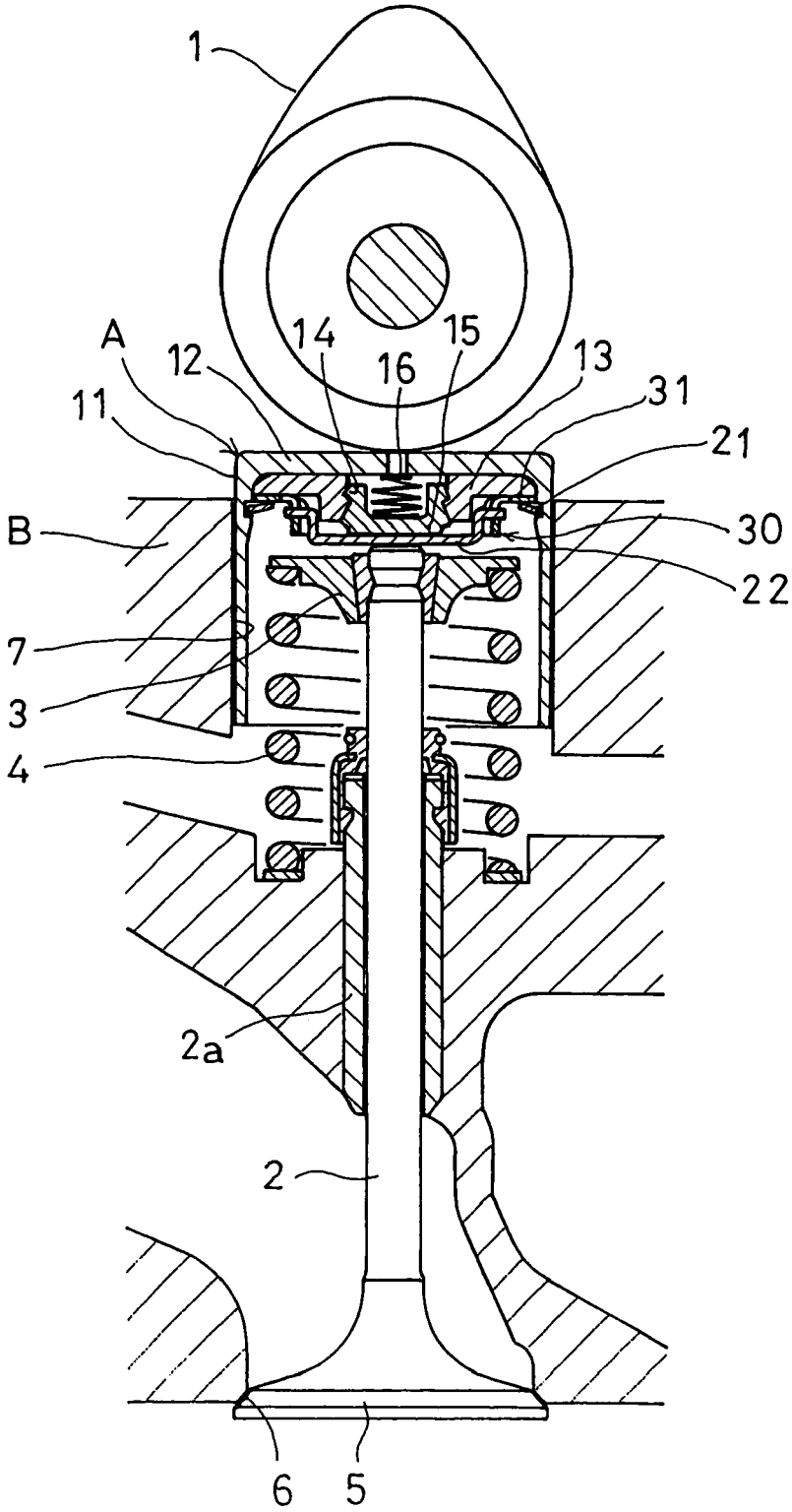
FIG. 1 is a vertical sectional front view of a valve gear using a lash adjuster embodying this invention.

An embodiment of this invention will now be described with reference to the drawings. FIG. 1 shows an example of a valve gear for opening and closing an intake port. The valve gear has a valve 5 for opening and closing an intake port formed in a cylinder head B. The valve 5 has a valve stem 2 which is axially slidably supported by a stem guide 2*a* mounted on the cylinder head B.

Figure 2:
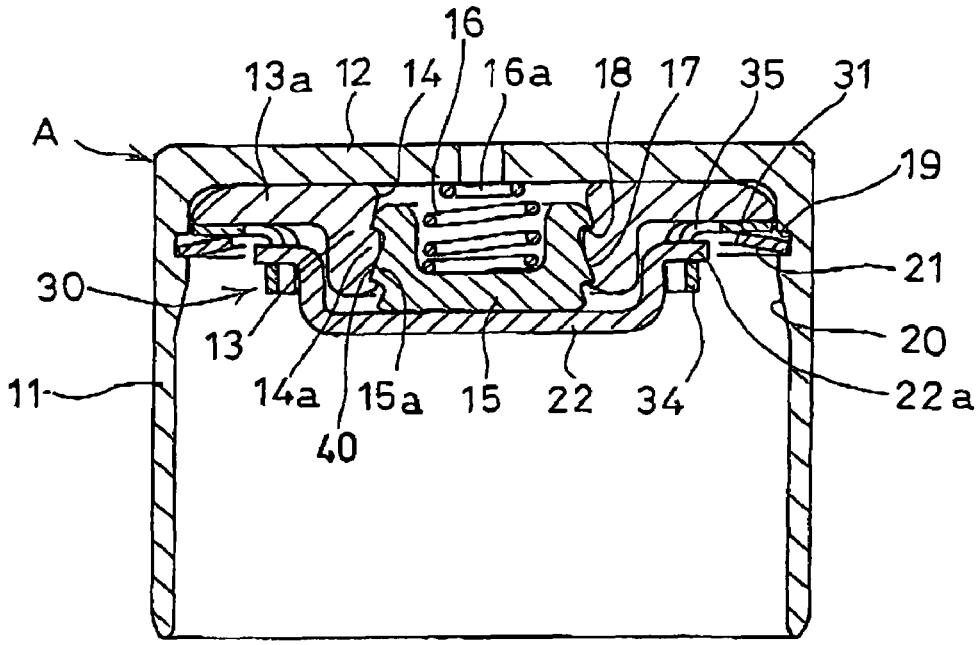
FIG. 2 is an enlarged sectional view of the lash adjuster.

Between the valve stem 2 and a cam 1 provided thereover, a lash adjuster A is mounted. The lash adjuster A is slidable along a guide hole 7 formed in the cylinder head B. As shown in FIG. 2, the lash adjuster A has a cylindrical lifter body 11 having its top closed. A protrusion is provided on the inner surface of an end plate 12 of the lifter body 11. The protrusion comprises a nut member 13. A flange 13*a* provided at the end of the nut member 13 is fixed to the inner surface of the end plate 12.

An adjuster screw 15 is in threaded engagement with a threaded hole 14 of the nut member 13 in which are formed double threads. A return spring 16 is mounted between the bottom of a recess formed in the top end face of the adjuster screw 15 and the inner surface of the end plate 12. The materials of the nut member 13, and the adjuster screw 15, and the material of their threaded surfaces are described later.

As shown in FIG. 1, at an upper portion of the valve stem 2, a valve retainer 3 is mounted. The valve retainer 3 is biased upwardly by a valve spring 4 mounted thereunder. Under its biasing force, the top end of the valve stem 2 is pressed against the bottom end of the adjuster screw 15, so that the top surface of the end plate 12 of the lash adjuster A is pressed against the cam 1.

As shown in FIG. 2, the threads of the adjuster screw 15 and the threaded hole 14, with which the adjuster screw 15 is in threaded engagement, are serration-shaped so that the flank angle of pressure flanks 17, which receive an axial push-in force applied to the adjuster screw 15 from the valve stem 2, is greater than the flank angle of clearance flanks 18. The relation between the flank angles and lead angles of the serration-shaped threads is such that the adjuster screw 15 is adapted to move downwardly while rotating under the elastic force of the return spring 16.

When the adjuster screw 15 is acted upon by a push-in force from the valve stem 2, the push-in force will be borne by the pressure flanks 17. Thus, the adjuster screw 15 hardly turns though it tends to be pushed in by vibration of the cam 1. It will move upwardly while rotating to a position where the force of the valve spring 4 balances with that of the return spring 16.

The return spring 16 comprises a cylindrical coil spring. An end coil portion 16*a* at one end thereof has a smaller diameter than the coil portion between the end coil portions at both ends. This return spring 16 is mounted such that the small-diameter end coil portion 16*a* touches the inner surface of the end plate 12 of the lifter body 11. The return spring 16 may be mounted such that the small-diameter end coil portion 16*a* is in contact with the adjuster screw 15.

Figure 3:
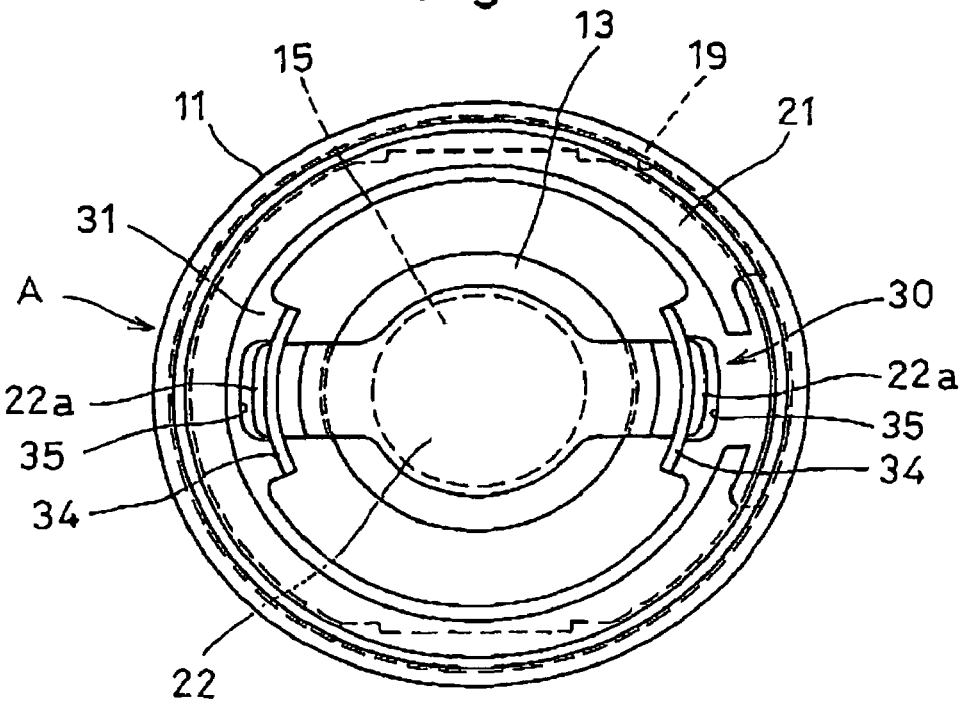
FIG. 3 is an enlarged plan view of the lash adjuster.

As shown in FIG. 2, at an upper portion of the inner periphery of the lifter body 11, an engaging groove 19 and a tapered surface 20 located thereunder are provided. An elastic ring 21 is mounted in the engaging groove 19. As shown in FIG. 3, the elastic ring 21 comprises a disk spring having one portion in its circumference cut off so as to be elastically deformable in diametric and axial directions. By the axial elastic force, the ring 21 presses the flange 13*a* at the outer periphery of the nut member 13 against the inner surface of the end plate 12 of the lifter body 11 to prevent the nut member 13 from turning relative to the lifter body 11.

The nut member 13 may be fixed to the end plate 12 by brazing to prevent it from turning relative to the lifter body 11. As shown in FIG. 1, a slide member 22 is mounted between the adjuster screw 15 and the valve stem 2. The slide member 22 is kept from turning relative to the nut member 13 by a retaining mechanism 30 but so as to be axially movable.

As shown in FIGS. 2 and 3, the retaining mechanism 30 has a ring-shaped turn-preventive member 31 provided under the nut member 13. The turn-preventive member 31 is fixed to the nut member 13 by, for example, caulking. A pair of guide pieces 34 extend downwardly from opposed positions of the inner periphery of the turn-preventive member 31. The guide pieces 34 are each formed with a guide hole 35 extending inwardly beyond the inner periphery of the turn-preventive member 31. On the other hand, L-shaped turn-preventive pieces 22*a* are provided at opposed positions of the outer periphery of the slide member 22. The turn-preventive pieces 22*a* are inserted in the guide holes 35 to prevent the slide member 22 from turning while allowing its axial movement. The turn-preventive member 31 is formed by pressing a thin metal plate.

In the valve gear of this structure, when the cam 1 is turned to push down the lash adjuster A with the protrusion of the cam 1, the valve stem 2 is pushed down by the adjuster screw 15, so that the valve 5 descends to open the intake port. When the base circle of the cam 1 opposes the end plate 12 of the lifter body 11, the elastic force of the valve spring 4 will raise the valve 5 and the lash adjuster A, thus closing the intake port.

During opening and closing of the valve 5, the distance between the base circle of the cam 1 and the top end of the valve stem 2 can change due to thermal expansion of the cylinder head B resulting from temperature change. If the distance increases, the adjuster screw will move downward while rotating under the elastic force of the return spring 16 to absorb the change in the distance.

On the other hand, if the cylinder head B shrinks due to cooling as a result of stoppage of the engine, the distance between the valve stem 2 and the base circle shortens. Immediately after restart from the cold state, a clearance between the cam base circle and the valve stem end is ensured by the axial play of the threads, and the push-in force gradually acts on the adjuster screw 15, so that the adjuster screw 15 moves upward while rotating to absorb the change in the distance.

Thus, even if the distance between the base circle of the cam 1 and the top end of the valve stem 2 changes, since the adjuster screw 15 moves axially and absorbs the change in the distance, no abnormal clearance will be formed between the cam 1 and the end plate 12 of the lifter body 11 and between the opposed portions of the valve stem 2 and the adjuster screw 15. Thus, the valve 5 can be opened and closed with high accuracy.

If a shift occurs in the distance between the cam 1 and the valve stem 2 from the optimum distance due to manufacturing or assembling errors, the adjuster screw 15 will move axially while rotating to absorb such a shift. This prevents any abnormal clearance from being formed between the cam 1 and the end plate 12 of the lifter body 11 and between the adjuster screw 15 and the valve stem 2.

The structure and function of the valve gear and the lash adjuster have been described. In this embodiment, as described above, a lash adjuster is used which can maintain the function as a valve gear even if FM oil is used for the automotive engine. This is because a material that will not react with oil additives containing organic molybdenum is used as the material of the nut member 13 and the adjuster screw 15, or the material of the pressure side thread surfaces that threadedly engage each other. Also, this suppresses the formation of tribochemical reactive film between the thread surfaces.

As such a non-reactive material, a chemically stable ceramic film may be formed from DLC, TiN, TiAlN, CrN, or TiCN on the pressure side thread surfaces of one or both of the nut member 13 and the adjuster screw 15. Also, besides ceramic film, plating such as hard chrome plating or electroless plating may be applied, or stainless, which is high in surface chemical stability, may be used as the material. Further, a nitride layer produced by nitriding treatment such as TUFFTRIDE® (salt bath soft nitriding) or sulfurizing, or an oxide film or carbon film are also chemically stable and have a non-metallic property and can be used. Such a ceramic film, plating, nitride layer, oxide film or carbon film is indicated by numeral 40 in FIG. 2. Otherwise, as the material for the threads of one or both of the nut member 13 and the adjuster screw 15, a nonferrous metal such as titanium or aluminum may be used. By using such a material, it is possible to suppress the formation of tribochemical reactive film.

As specific examples of such plating treatment and carbon or ceramic film, the following can be cited. As the carbon film, a diamond-like carbon film may be used, and as the ceramic film, titanium nitride TiN or chrome nitride CrN may be used. As the plating treatment, the Ni—P plating, or Ni—P plating and treatment in which a hard particle-dispersed film such as SiC or $Si_3N_4$ is formed, or Ni—P plating and treatment in which PTFE-dispersed film is formed, may be used.

Figure 4:
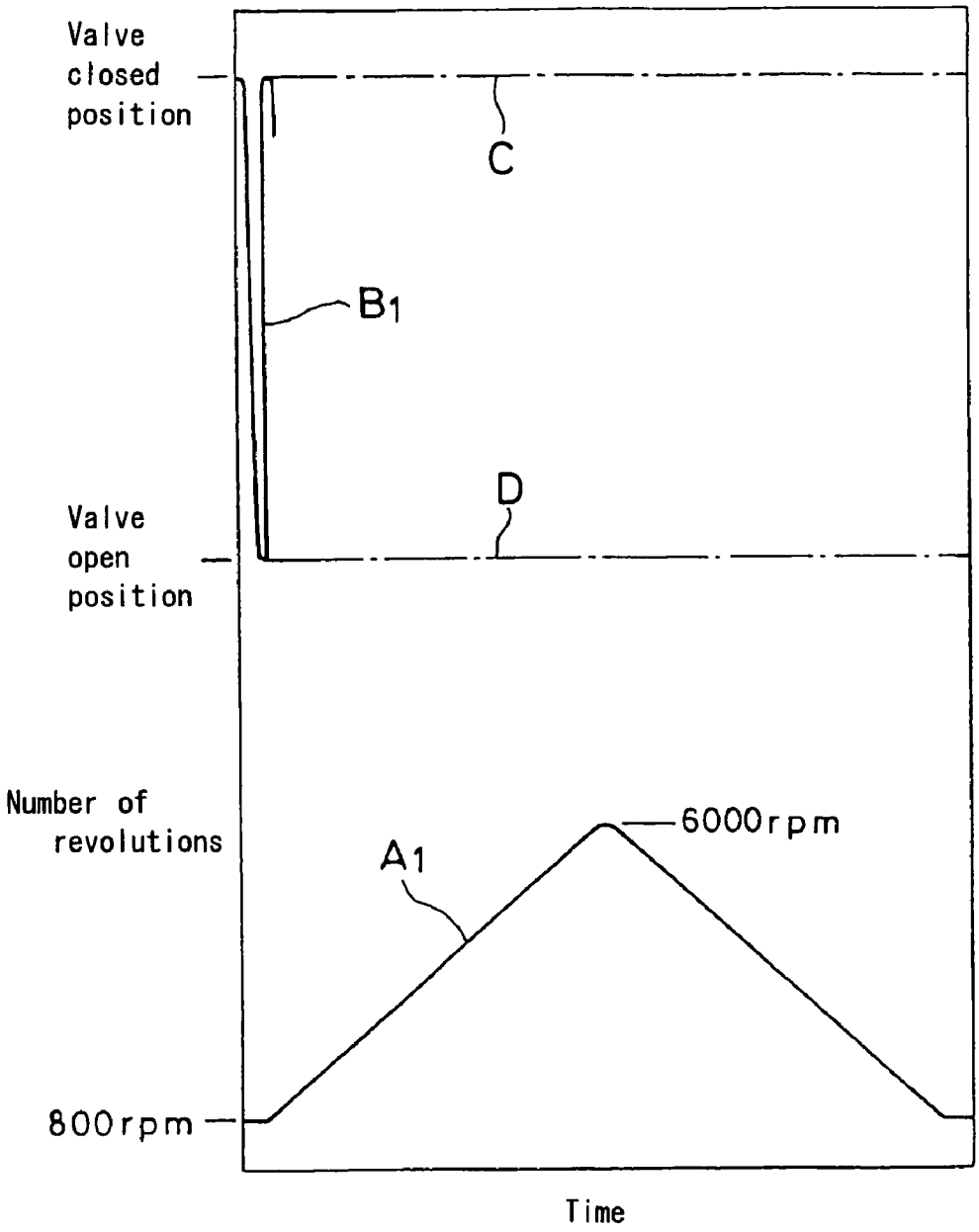
FIG. 4 is a graph showing measurement results for the valve lift of the lash adjuster with FM oil used (adjuster screw and nut member formed with TiN layer)

FIG. 4 shows measurement results in a sweep test for the number of revolutions of the lash adjuster of the above embodiment. The illustrated example is for a case in which a nitride layer of titanium nitride (TiN) is formed on pressure side thread surfaces of both the nut member and the adjuster screw. In the graph, the bent line A1 at the lower portion of the graph shows the number of revolutions of a crankshaft, which linearly accelerates from 800 rpm in idling to a maximum of 6000 rpm, and again linearly decelerates to 800 rpm.

The upper portion of the graph shows a lift curve B1 of the valve 5. While in the graph, only one lift curve is shown enlarged, actually, such lift curves appear continuously in the direction of the horizontal axis (time axis) of the graph such that in a region where the number of revolutions of the crankshaft is low, the density of lift curves is coarse, and as the number of revolutions increases, the density of lift curves increases. Since it is difficult to accurately draw such lift curves, they are shown by connecting a valve closed position and a valve open position of a continuous lift curve. The upper line A indicates the valve closed position and the lower line B indicates the valve open position.

Figure 7:
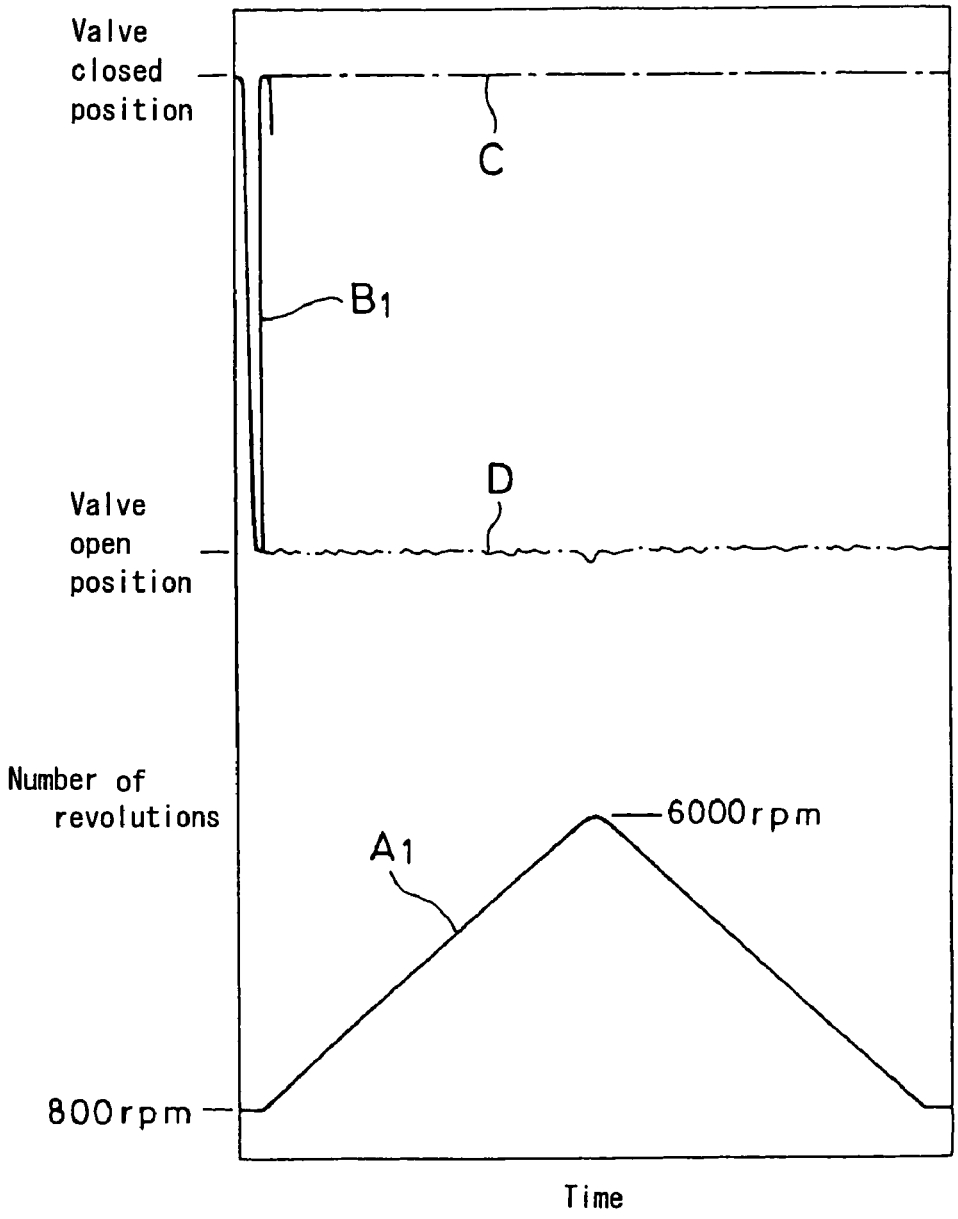
Fig.7 Prior Art
FIG. 7 is a graph showing measurement results for the valve lift of a prior art lash adjuster with FM oil used (adjuster screw and nut member made of carburizing steel subjected to carburizing)
Figure 8:
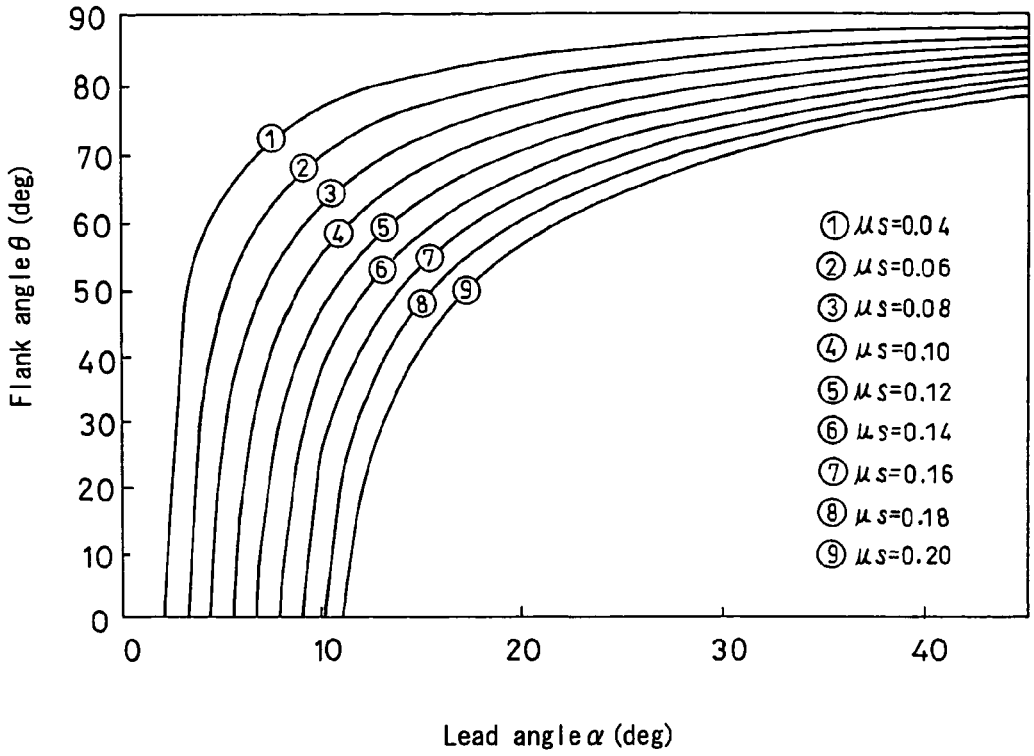
FIG. 8 is a graph showing relationship between thread specs and self-sustainable friction coefficient.

As will be apparent from the illustrated measurement results, it will be understood that even under conditions in which FM oil is used, if a lash adjuster subjected to TiN film treatment is used, the bottom ends of the valve lift curves are substantially linear. This shows that the valve lift amount is very stable. As a comparative example, measurement results for a conventional lash adjuster using an adjuster screw and a nut member made from carburizing steel subjected to carburizing are shown in FIG. 7. Under conditions in which FM oil is used, the bottom ends of the valve lift curves fluctuate about 0.2–0.3 mm and are not stable.

Figure 5:
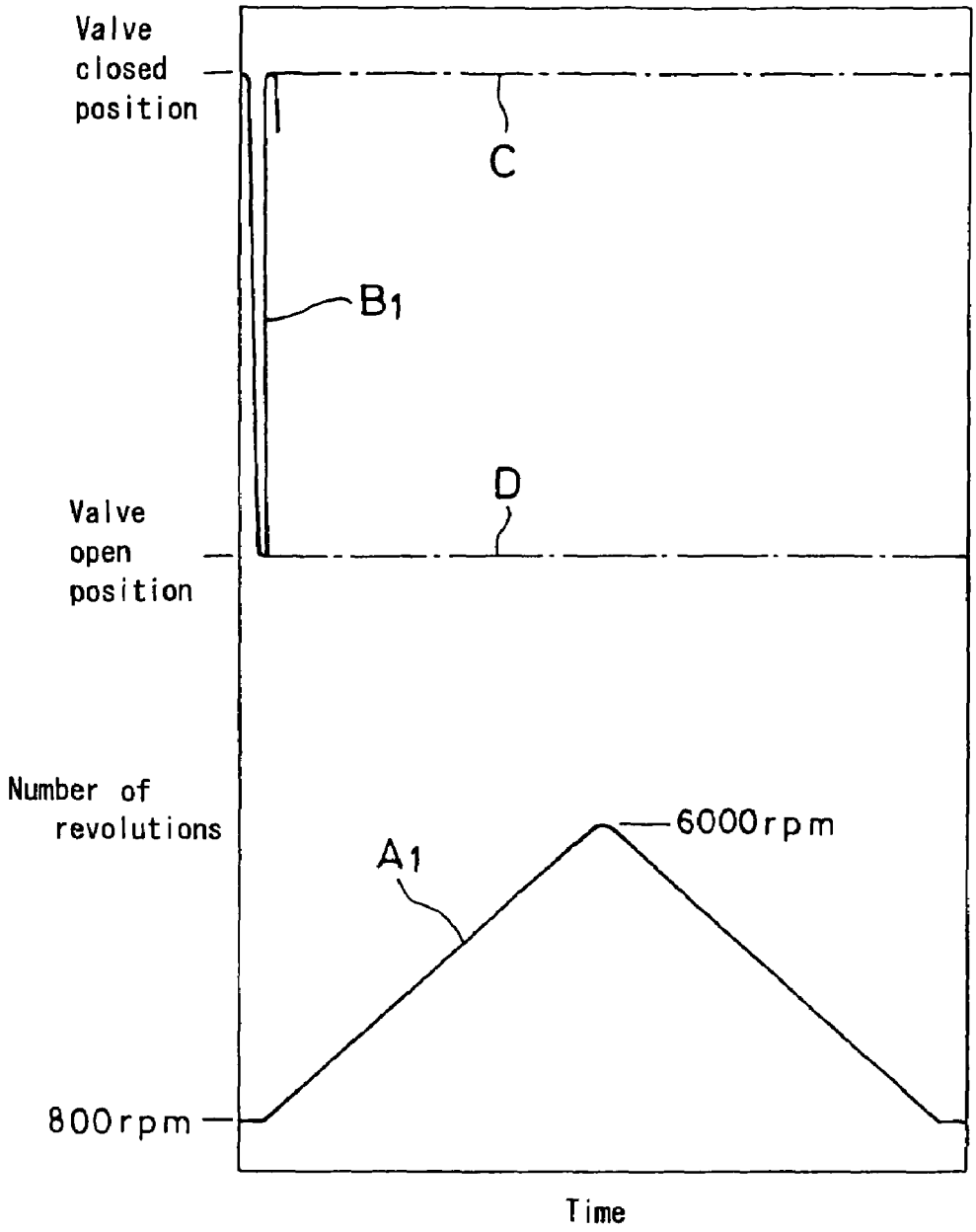
FIG. 5 is a similar graph with FM oil used (adjuster screw formed with DLC ceramic film)
Figure 6:
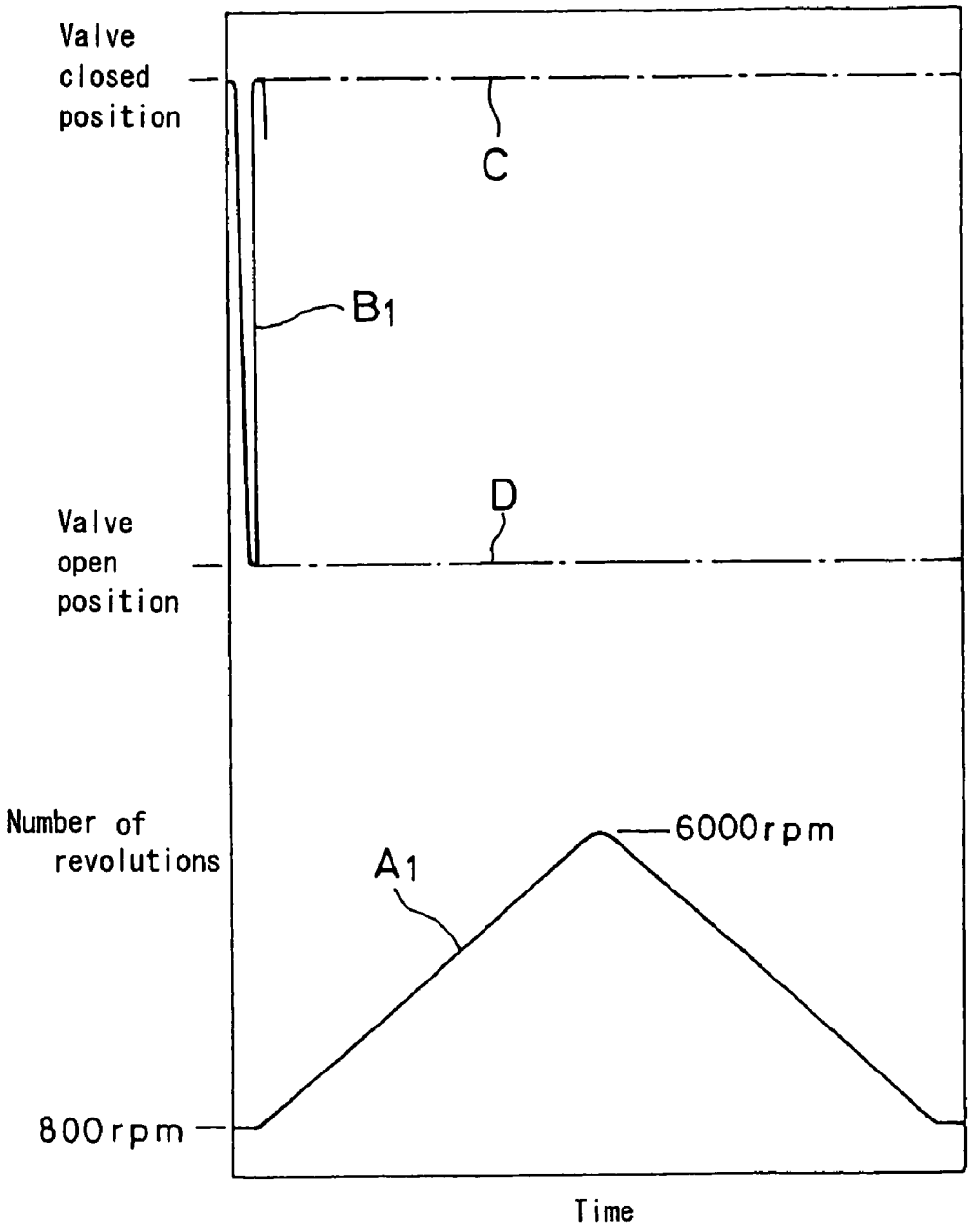
FIG. 6 is a similar graph with FM oil used (nut member: plating treatment)

FIGS. 5 and 6 show measurement results for a case in which DLC film treatment is applied to the adjuster screw only, and a case in which electroless nickel plating is applied to the nut member only, respectively. It is apparent that the valve lift amount is very stable in either case. Needless to say, FM oil is used in both cases.

In the above embodiment, as an example, description has been made of a valve gear employing the lash adjuster A shown in FIG. 1. But there are various shapes and types of the lash adjuster. The invention is applicable to any of them as long as the adjuster screw and the nut member are similar to those of the above embodiment.

As described above, in the lash adjuster of this invention, since one or both of the adjuster screw and the nut member, or the pressure side thread surfaces of one or both of them, are formed of a material that will not react with oil additives containing organic molybdenum (FM oil), even if FM oil is used for the engine, it will not lose its function as the lash adjuster in a valve gear, and a stable valve lift is maintained.

What is claimed is:

1. A lash adjuster for use in a valve gear, comprising:

a lifter body to be axially slidably mounted in a valve opening-and-closing transmission path to transmit a force from a cam to a valve through a valve stem;

a nut member on said lifter body, said nut member having female threads;

an adjuster screw having peripheral male threads engaging said female threads of said nut member, said adjuster screw being shaped and arranged to move axially by rotating within said nut member so as to automatically adjust a valve clearance; and an elastic member for axially biasing said adjuster screw;

wherein said female threads of said nut member and said male threads of said adjuster screw are each serration-shaped so as to have pressure flanks to be acted on by an axial push-in force to be applied to said adjuster screw and so as to have clearance flanks, a flank angle of said pressure flanks being greater than a flank angle of said clearance flanks;

wherein a pressure-side thread surface of one or both of said adjuster screw and said nut member is formed of a material that will not react with oil additives of oil containing organic molybdenum so as to suppress formation of a tribochemical reactive layer between said thread surfaces; and wherein said pressure-side thread surface of one or both of said adjuster screw and said nut member has a ceramic film formed thereon.

2. The lash adjuster of claim 1, wherein said pressure-side thread surface of one or both of said adjuster screw and said nut member has titanium nitride TiN formed thereon.

3. The lash adjuster of claim 1, wherein said pressure-side thread surface of one or both of said adjuster screw and said nut member has chrome nitride formed thereon.

4. A lash adjuster for use in a valve gear, comprising:

a lifter body to be axially slidably mounted in a valve opening-and-closing transmission path to transmit a force from a cam to a valve through a valve stem;

a nut member on said lifter body, said nut member having female threads;

an adjuster screw having peripheral male threads engaging said female threads of said nut member, said adjuster screw being shaped and arranged to move axially by rotating within said nut member so as to automatically adjust a valve clearance; and an elastic member for axially biasing said adjuster screw;

wherein said female threads of said nut member and said male threads of said adjuster screw are each serration-shaped so as to have pressure flanks to be acted on by an axial push-in force to be applied to said adjuster screw and so as to have clearance flanks, a flank angle of said pressure flanks being greater than a flank angle of said clearance flanks;

wherein a pressure-side thread surface of one or both of said adjuster screw and said nut member is formed of a material that will not react with oil additives of oil containing organic molybdenum so as to suppress formation of a tribochemical reactive layer between said thread surfaces; and wherein said pressure-side thread surface of one or both of said adjuster screw and said nut member is subjected to plating.

5. The lash adjuster of claim 4, wherein said pressure-side thread surface of one or both of said adjuster screw and said nut member is subjected to Ni—P plating, and a hard particle-dispersed film is formed thereon.

6. The lash adjuster of claim 5, wherein said hard particle-dispersed film comprises one of SiC and $Si_3N_4$.

7. A lash adjuster for use in a valve gear, comprising:

a lifter body to be axially slidably mounted in a valve opening-and-closing transmission path to transmit a force from a cam to a valve through a valve stem;

a nut member on said lifter body, said nut member having female threads;

an adjuster screw having peripheral male threads engaging said female threads of said nut member, said adjuster screw being shaped and arranged to move axially by rotating within said nut member so as to automatically adjust a valve clearance; and an elastic member for axially biasing said adjuster screw;

wherein said female threads of said nut member and said male threads of said adjuster screw are each serration-shaped so as to have pressure flanks to be acted on by an axial push-in force to be applied to said adjuster screw and so as to have clearance flanks, a flank angle of said pressure flanks being greater than a flank angle of said clearance flanks;

wherein a pressure-side thread surface of one or both of said adjuster screw and said nut member is formed of a material that will not react with oil additives of oil containing organic molybdenum so as to suppress formation of a tribochemical reactive layer between said thread surfaces; and wherein said pressure-side thread surface of one or both of said adjuster screw and said nut member has a nitride compound layer formed thereon.

8. A lash adjuster for use in a valve gear, comprising:

a lifter body to be axially slidably mounted in a valve opening-and-closing transmission path to transmit a force from a cam to a valve through a valve stem;

a nut member on said lifter body, said nut member having female threads;

an adjuster screw having peripheral male threads engaging said female threads of said nut member, said adjuster screw being shaped and arranged to move axially by rotating within said nut member so as to automatically adjust a valve clearance; and an elastic member for axially biasing said adjuster screw;

wherein said female threads of said nut member and said male threads of said adjuster screw are each serration-shaped so as to have pressure flanks to be acted on by an axial push-in force to be applied to said adjuster screw and so as to have clearance flanks, a flank angle of said pressure flanks being greater than a flank angle of said clearance flanks;

wherein a pressure-side thread surface of one or both of said adjuster screw and said nut member is formed of a material that will not react with oil additives of oil containing organic molybdenum so as to suppress formation of a tribochemical reactive layer between said thread surfaces; and wherein said pressure-side thread surface of one or both of said adjuster screw and said nut member has a carbon film formed thereon.

9. The lash adjuster of claim 8, wherein said pressure-side thread surface of one or both of said adjuster screw and said nut member has a diamond film formed thereon.

* * * * *